US005114029A

United States Patent [19]

Gibilisco

[11] Patent Number: 5,114,029

[45] Date of Patent: May 19, 1992

[54] CHILD RESISTANT BOTTLE CLOSURE ASSEMBLAGE

[75] Inventor: Kenneth J. Gibilisco, Coopersburg, Pa.

[73] Assignee: Merck & Co., Inc., Rahway, N.J.

[21] Appl. No.: 727,708

[22] Filed: Jul. 10, 1991

[51] Int. Cl.[5] ..... B65D 55/02

[52] U.S. Cl. ..... 215/220; 215/217; 215/204; 215/210; 215/334

[58] Field of Search ..... 215/217, 210, 218, 219, 215/220, 221, 250, 203, 204, 208, 332, 334, 338

[56] References Cited

U.S. PATENT DOCUMENTS

| | | | |
|---|---|---|---|
| 2,597,307 | 5/1952 | Elkind | 215/220 |
| 3,129,834 | 4/1964 | Kimball | 215/221 X |
| 3,514,003 | 5/1970 | Fitzgerald | 215/221 |
| 3,595,417 | 7/1971 | Musher | 215/208 X |
| 3,771,685 | 11/1973 | Micallef | 215/220 |
| 3,901,400 | 8/1975 | Westfall | 215/221 |
| 3,923,179 | 12/1975 | Choksi et al. | 215/203 |
| 3,950,917 | 4/1976 | Choksi et al. | 215/204 X |
| 4,006,836 | 2/1977 | Micallef | 215/218 |
| 4,317,526 | 3/1982 | Plitz | 215/217 |
| 4,865,209 | 9/1989 | Bush | 215/216 |

*Primary Examiner*—Stephen Marcus
*Assistant Examiner*—Vanessa Caretto
*Attorney, Agent, or Firm*—Salvatore C. Mitri; Charles M. Caruso

[57] ABSTRACT

There is disclosed a child resistant bottle closure assemblage comprising an outer cap member, an inner cap member and an interlocking member disposed between the inner and outer cap members. When secured to a bottle in its normal, upright position, the outer cap member can be rotated without engaging the interlocking member so that the assemblage can not be removed from the bottle. When the bottle is inverted so that the interlocking member engages the outer cap member, rotation of the outer cap member results in removal of the entire assemblage from the bottle.

8 Claims, 5 Drawing Sheets

CHILD RESISTANT BOTTLE CLOSURE ASSEMBLAGE

BACKGROUND OF THE INVENTION

This invention is directed toward a child resistant bottle closure assemblage which can be used to seal containers for such items as detergents, insecticides, pharmaceuticals, and the like.

Typical child resistant bottle closures usually require the user to perform some preliminary manipulations before the bottle can be opened. For example, there are bottle closures that require the user to align a mark on the closure with a mark on the bottle in order to remove the closure (normally, a snap off cap). Other closures require the user to squeeze or pinch the closure while simultaneously rotating it to remove it. Still other closures require the user to exert downward pressure on the closure and simultaneously rotate the closure in order to remove it from the bottle.

Although such closures are effective, they require the exertion of some strength by the user. Many users, because of illness, manual deformation, manual flexibility limitations, and the like either have difficulty in removing the closures or are unable to remove them at all. In addition, although such closures are touted as "child resistant", "tamper proof", and the like, observant and innovative children have been known to readily remove such closures.

SUMMARY OF THE INVENTION

It has now been found that shortcomings of typical child resistant bottle closures are overcome by the bottle closure assemblage of this invention which requires minimum manipulation and exertion by the user and, although simple to use, presents a formidable challenge to children who attempt to remove the closure from a bottle.

The child resistant bottle closure assemblage of the invention generally comprises an outer cap member, an inner cap member and an interlocking member.

The inner cap member is cylindrical and is provided with means to be secured to a bottle, such as by conventional mating threads or conventional snap-on/snap-off mating beads and grooves, and serves to seal the contents of the bottle from air and moisture. The inner cap member is formed with a plurality of spaced, external grooves about its outer circumferential surface, these grooves being formed so that they are parallel to each other and parallel to the longitudinal axis of the inner cap.

The interlocking member is also cylindrical and has a closed upper end and an open lower end. Spaced upwardly from its lower end, are a plurality of spaced pins projecting inwardly from its inner circumferential surface and a plurality of spaced pins projecting outwardly from its outer circumferential surface. The inwardly projecting pins are spaced so that they engage and mate with the external grooves in the outer circumferential surface of the inner cap member thus securing the interlocking member to the inner cap member while enabling the interlocking member to freely slide vertically up and down in the external grooves of the inner cap member. The closed, upper end of the interlocking member limits its downward movement along the external grooves of the inner cap member.

The outer cap member is cylindrical and open at each end, the lower end having means to rotatably secure the outer cap member to the lower end of the inner cap member with the interlocking member contained between the outer cap and the inner cap members.

A plurality of spaced grooves are formed about the inner circumferential wall of the outer cap member. These grooves are formed so that they are parallel to each other, but angularly off-set from the longitudinal axis of the outer cap member.

When the assembled bottle closure members are secured to a bottle in its normal, up-right position, the outer cap member can be rotated without engaging the interlocking member and the bottle will remain closed.

When the bottle is inverted, this permits the interlocking member to fall by gravity toward the upper end of the outer cap member. With the interlocking member in this position, the outer cap member can then be slowly rotated until the outwardly projecting pins of the interlocking member engage the angular, inner grooves of the outer cap member permitting the interlocking member to slide downwardly through the outer cap member along its angular grooves until the interlocking member extends outwardly beyond the upper, planar surface of the outer cap member. When this occurs, all the members are interlocked so that the bottle can be reinverted to its normal up-right position and the outer cap member or the protruding portion of the interlocking member or both of these members can be grasped and the entire bottle closure assemblage removed to open the bottle; e.g., by unscrewing or snapping off the interlocked bottle closure assemblage.

In a further embodiment, the bottle closure assemblage of the invention includes a tamper evident means. One such means can be in the form of a tab member positioned across the open, upper end of the outer cap member and formed as an integral part of the outer cap member. This tab member is produced so that it can be readily removed from the outer cap member by breaking it off without undue effort. Before being removed, the tab member prevents the interlocking member from extending through the open, upper end of the outer cap member and also prevents the members of the bottle closure assemblage from being fully engaged and interlocked so that the bottle can not be opened. In addition, a message can be provided on the outer, upper surface of the interlocking member alerting the user that unless the user has removed the tab member, a missing tab member might indicate that the integrity of the contents of the bottle may have been compromised.

DETAILED DESCRIPTION OF THE INVENTION

The bottle closure assemblage of the invention will become more apparent from the ensuing description when considered together with the accompanying drawing wherein like reference numerals denote like parts and wherein.

Figure 1:
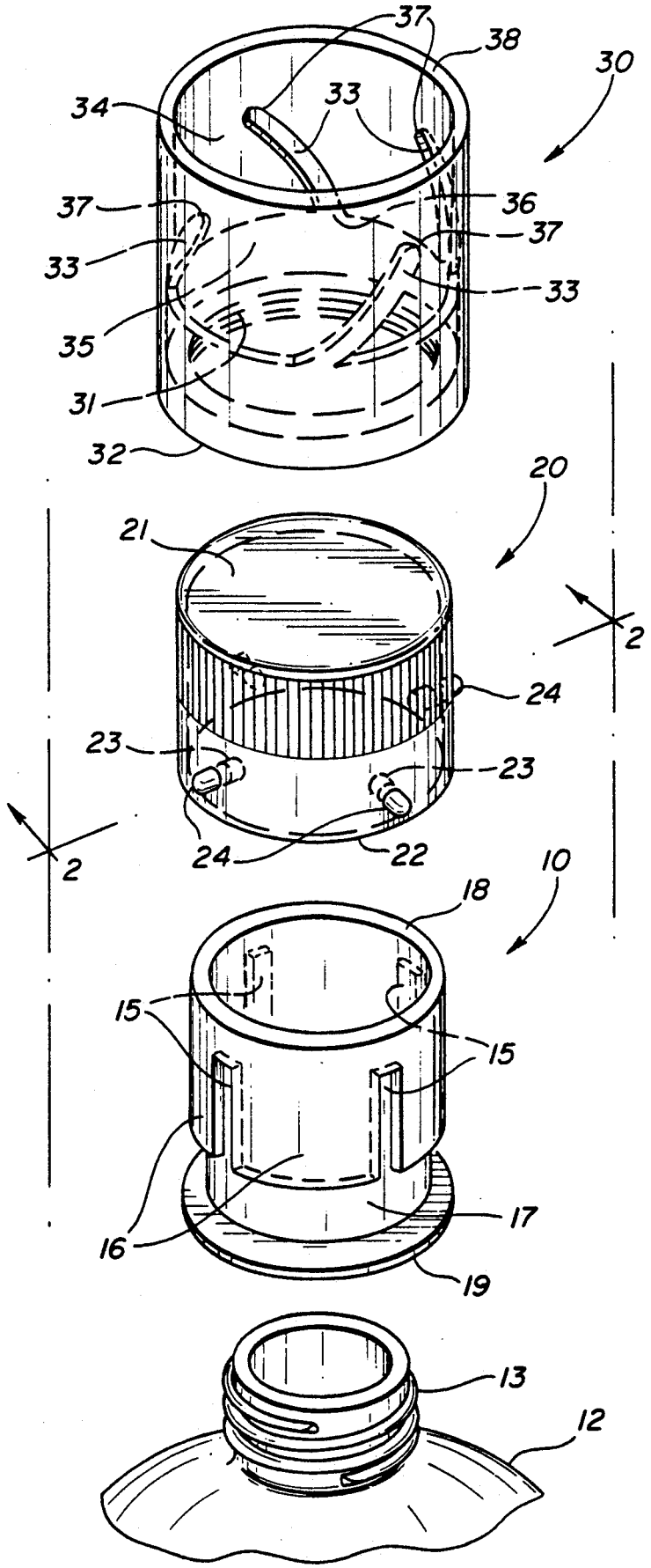
FIG. 1 is a perspective view showing the members of the bottle closure assemblage in exploded relation to each other and to a bottle to which they can be secured when assembled.
Figure 2:
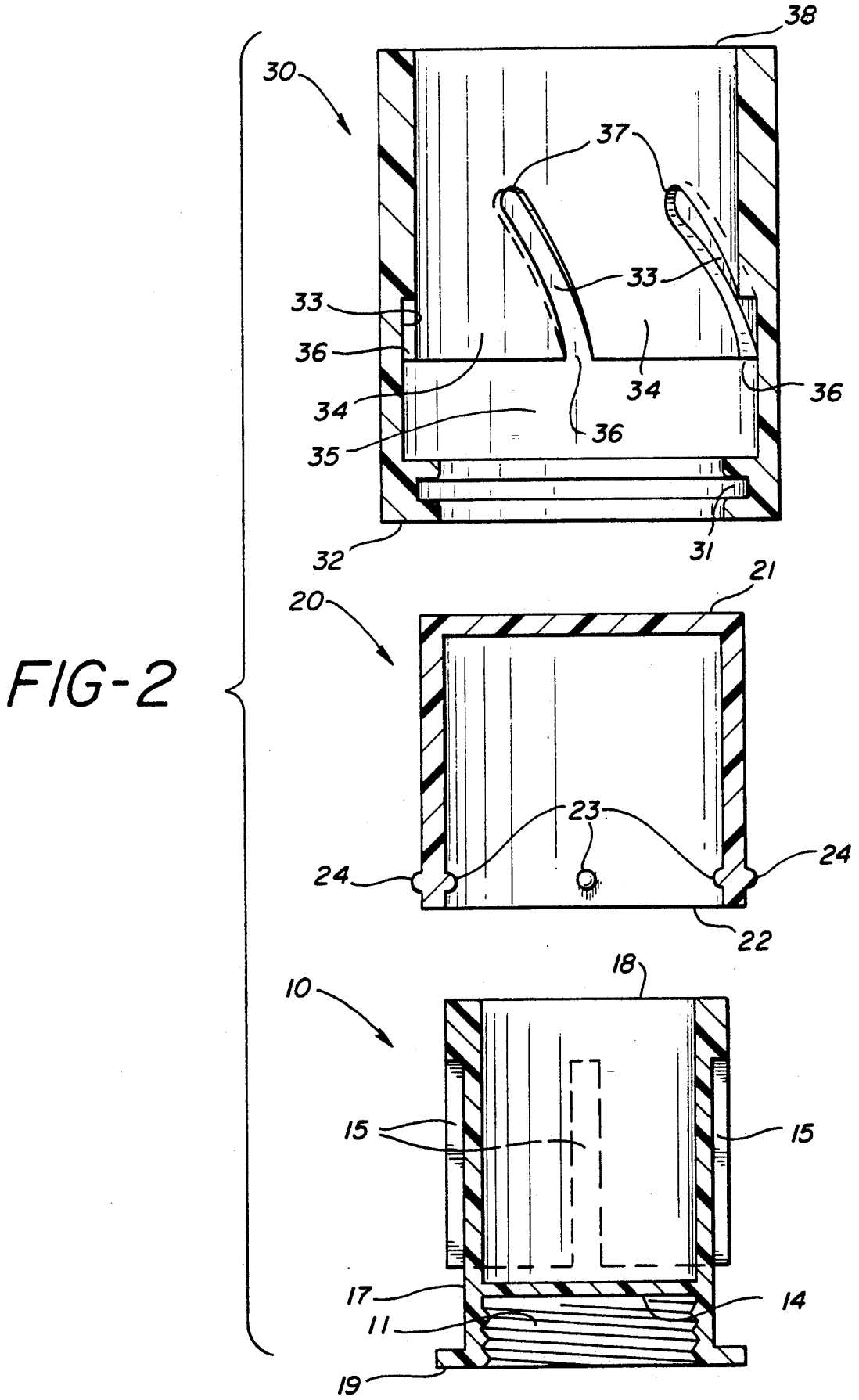
FIG. 2 is a sectional view taken substantially on the line 2—2 of FIG. 1.

As shown in FIGS. 1 and 2, the bottle closure assemblage of the invention comprises a cylindrical inner cap 10, a cylindrical interlocking member 20 and a cylindrical outer cap 30.

At its lower end, inner cap 10 is provided with conventional means, such as threads 11, so that it can be secured to a bottle 12 by means of mating threads 13. Alternatively, inner cap 10 can be secured to a bottle 12 by any conventional means such as snap-on, snap-off means (not shown) which enable the bottle closure assemblage to be snapped onto and off of a bottle.

At the upper end of threads 11 of inner cap 10 is a sealing member 14 (FIG. 2) which serves to seal bottle 12 and protect its contents from contamination by air and moisture when inner cap 10 is secured to a bottle.

Inner cap member 10 has a plurality of spaced grooves 15 formed in the land portion 16 of its outer circumferential surface, reference numeral 17 denoting the base of land 16 and reference numeral 18 denoting the upper end of inner cap 10. Spaced grooves 15 are preferably provided in the lower portion of inner cap 10, and are formed to be parallel to each other and parallel to the longitudinal axis of inner cap 10. For purposes of economy, inner cap 10 is tubular except for sealing member 14.

Cylindrical interlocking member 20 has a closed upper end 21 and an open lower end 22. A plurality of spaced, inwardly projecting pins 23 (FIG. 2) are provided about the inner circumferential wall of interlocking member 20 adjacent its open, lower end 22. Similarly, a plurality of spaced, outwardly projecting pins 24 are provided about the outer circumferential wall of interlocking member 20 adjacent is open, lower end 22. Inwardly projecting pins 23 and outwardly projecting pins 24 are preferably located in the lower half of interlocking member 20.

Inner cap 10 and interlocking member 20 are sized so that interlocking member 20 can be fitted over inner cap 10 with inner pins 23 of interlocking member 20 engaged in the grooves 15 of inner cap 10. In this arrangement, interlocking member 20 is not only securely locked to inner cap 10, but is also free to slide vertically upwardly and downwardly in and along grooves 15. The extent of the downward, sliding movement of interlocking member 20 along grooves 15 is arrested and limited by the closed end 21 contacting the upper end 18 of inner cap 10.

Cylindrical outer cap 30 is tubular and has an inwardly extending circumferential recess 31 (FIG. 2) formed at its open, lower end 32. Positioned upwardly from open, lower end 32 are a plurality of spaced grooves 33 formed in the land 34 on the inner circumferential wall of outer cap 30, reference numeral 35 identifying the base of land 34. Grooves 33 are preferably contained in the upper half of outer cap 30 and have an open lower end 36, a closed upper end 37 and are formed to be parallel to each other, but angularly off-set from the longitudinal axis of outer cap 30 so that grooves 33 are similar to rifling in the bore of a rifle.

Figure 5:
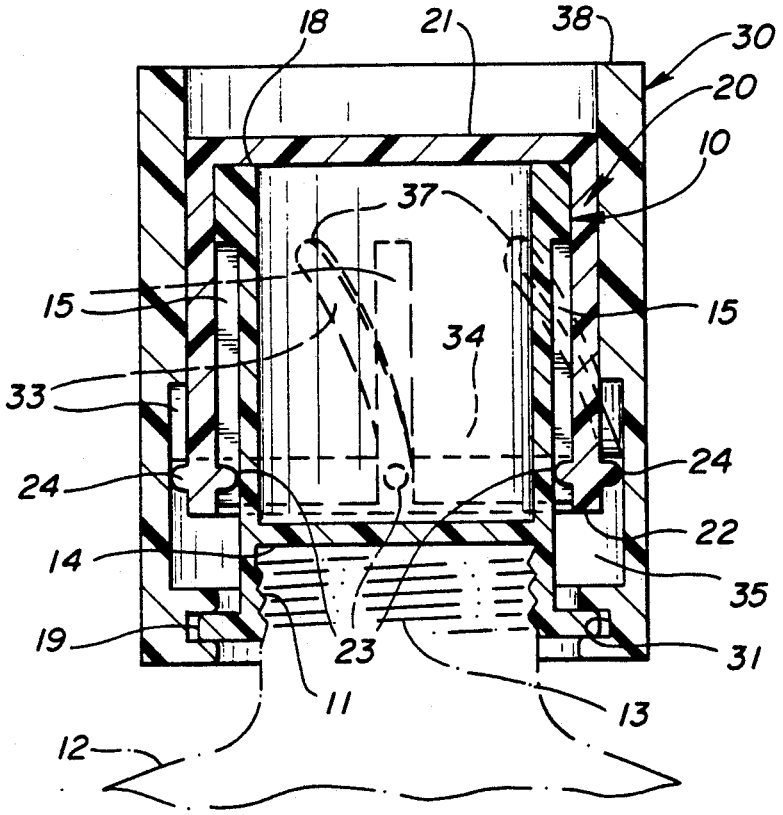
FIG. 5 is a sectional view taken substantially on the line 5—5 of FIG. 3 but showing the members in assembled relationship to each other.

As shown in FIG. 5, outer cap 30 is sized so that it can be positioned over both the interlocking member 20 and the inner cap 10 with the recess 31 of outer cap 30 engaging the lower circumferential end 19 of inner cap 10 so that outer cap 30 is rotatably secured to inner cap 10.

Thus, the diameter of base 35 of outer cap 30 is sized to be slightly larger than the diameter of land 34 and slightly larger than the circumferential plane defined by the extremities of outwardly projecting pins 24 of the interlocking member 20.

Figure 3:
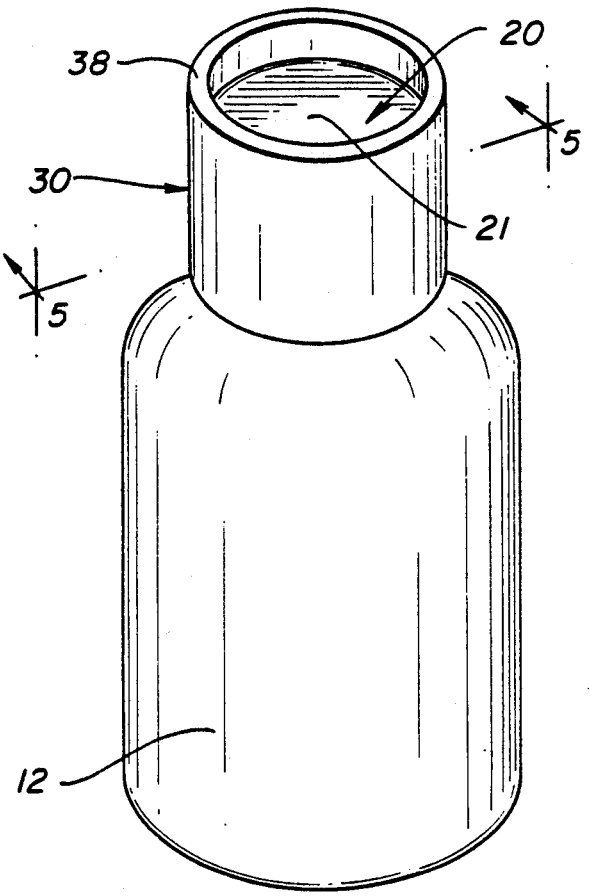
FIG. 3 is a perspective view illustrating the bottle closure assemblage as it would appear secured to a bottle its normal, up-right position.
Figure 4:
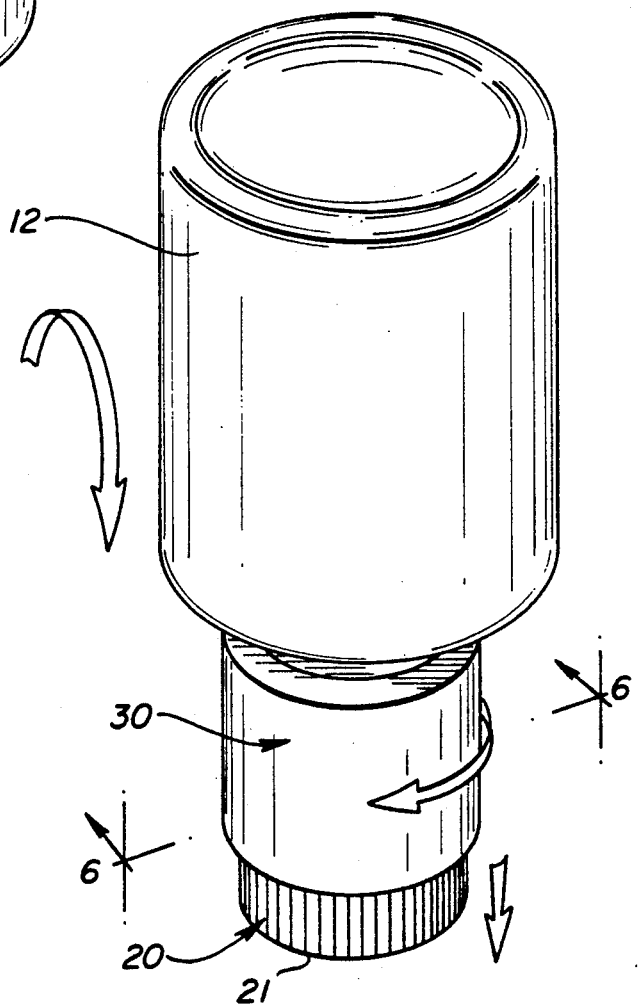
FIG. 4 is a perspective view illustrating the bottle closure assemblage shown in FIG. 3 after the bottle has been inverted with the interlocking member extending beyond the upper, planar surface of the outer cap member enabling the assemblage to be removed from the bottle.
Figure 6:
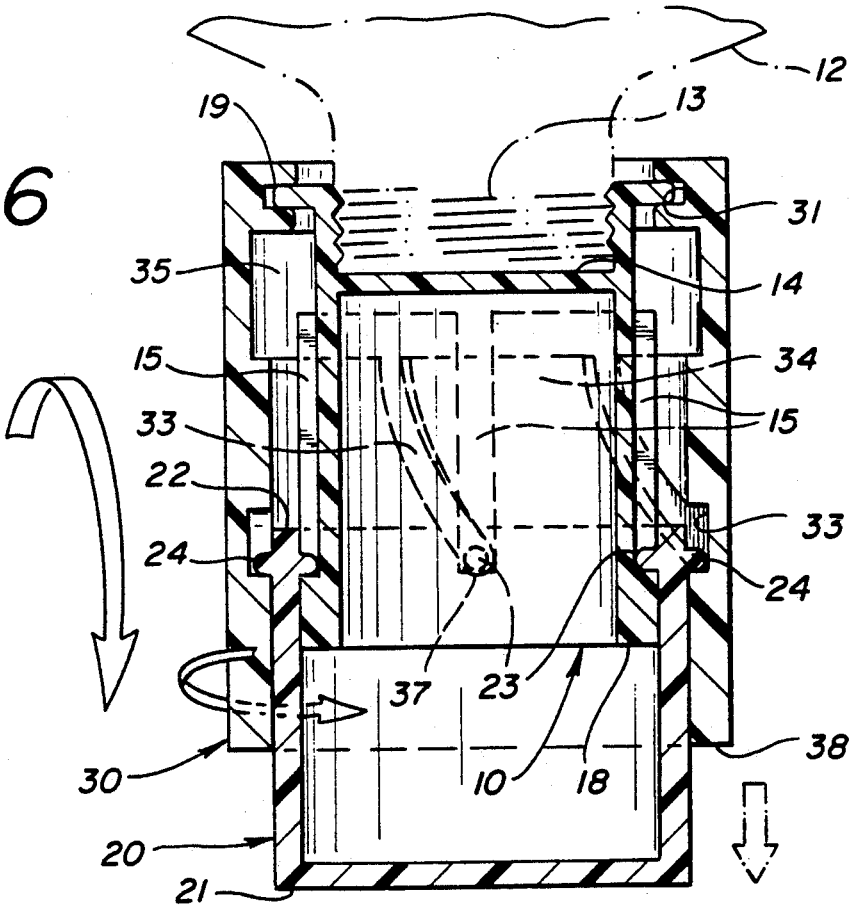
FIG. 6 is a sectional view taken substantially on the line 6—6 of FIG. 4.

In this arrangement, outer cap 30 can be freely rotated without engaging the interlocking member 20 so that the assembled bottle closure cannot be removed from a bottle and, when secured to a bottle 12 appears as shown in FIG. 3. However, when bottle 12 is inverted to an up-side down position as seen in FIG. 4, interlocking member 20 slidably falls from the force of gravity toward the open, upper end 38 of outer cap 30. Unless outwardly projecting pins 24 of interlocking member 20 happen by chance to be aligned with the open ends 36 of grooves 33, further descent of interlocking member 20 will be arrested when its outwardly projecting pins 24 contact land 34. While in this position, outer cap 30 is rotated until outwardly projecting pins 24 are aligned with and engage the open lower ends 36 of grooves 33. When this occurs, interlocking member 20 is free to slidably fall along grooves 33 toward and through the open end 38 of outer cap 30 until outwardly projecting pins 24 engage the closed upper ends 37 of grooves 33 permitting a portion of the interlocking member 20 to extend beyond the open, upper end 38 of outer cap 30 as illustrated in FIGS. 4 and 6. At this time, outer cap 30 is secured to inner cap 10 through interlocking engagment of outwardly projecting pins 24 in grooves 33 and interlocking engagement of inwardly projecting pins 23 in grooves 15. The bottle 12 can then be re-inverted to its normal up-right position and the interlocked bottle closure assemblage removed by unscrewing (or snapping off) outer cap 30.

To re-secure the bottle closure assemblage to a bottle, the same procedure is followed (i.e., the outer cap 30 is turned up-side down and rotated until the interlocking member 20 extends beyond the open, upper end 38 of outer cap 30) and the interlocked bottle closure assemblage is screwed onto (or snapped onto) the bottle.

Figure 7:
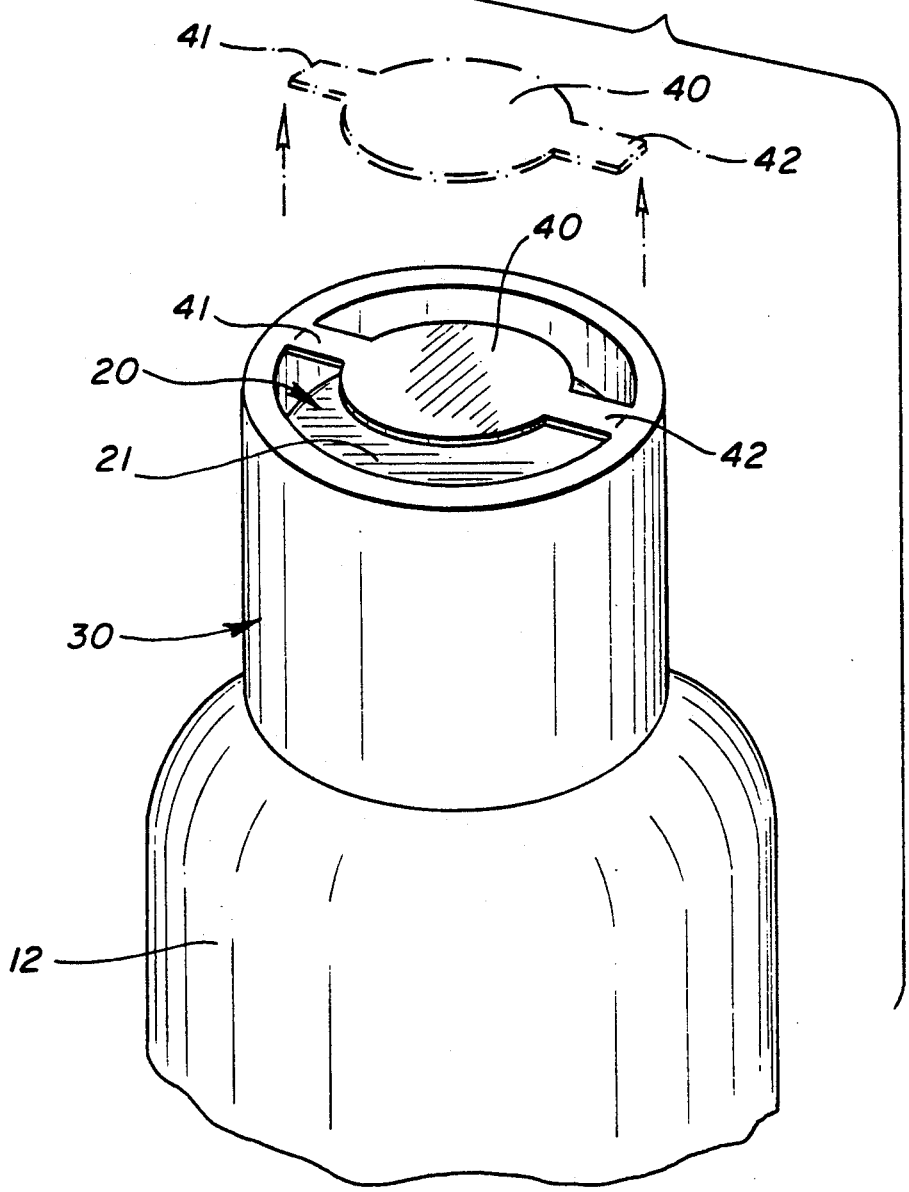
FIG. 7 is a perspective view illustrating a tamper evident means that can be provided with the bottle closure assemblage of the invention.

The bottle closure assemblage of the invention can also be provided with tamper evident means. As illustrated in FIG. 7, one such means can be in the form of a break-off tab 40 which is secured across the open, upper end 38 of outer cap 30 by means of legs 41, 42. Tab 40 can be fabricated as an integral part of outer cap 30 and be such that it can be removed from outer cap 30 by readily breaking it away at legs 41 and 42 as shown by the dashed extension lines in FIG. 7.

Prior to its removal, break-off tab 40 prevents interlocking member 20 from being extended beyond the open, upper end 38 of outer cap 30 so that the bottle closure assemblage cannot be removed from a bottle. By providing a message on the outer exposed surface of closed upper end 21 of interlocking member 20, a user can be alerted to the fact that unless the user has removed tab 40, the integrity of the bottle contents may have been compromised.

In the foregoing description of the bottle closure assemblage of the invention, reference has been made to a plurality of grooves 15 on inner cap 10, a plurality of inwardly projecting pins 23 and outwardly projecting pins 24 on interlocking member 20, and a plurality of angularly off-set grooves 33 in outer cap 30. It should be understood, however, that the bottle closure assemblage of the invention is operable with a single groove 15 on inner cap 10, a single inwardly projecting pin 23 and a single outwardly projecting pin 24 on interlocking member 20 and a single, angularly off-set groove 33 in outer cap 30. Preferably, at least two, more preferably at least four, such grooves and pins should be provided and each should be equi-spaced. Thus, while the bottle closure assemblage of the invention has been described with particularity and in detail, it should be understood that modifications can be made therein without departing from the scope of the invention defined in the claims.

What is claimed is:

1. A bottle closure assemblage comprising:

(a) an inner cap member having means to be secured to and seal the contents of a bottle, and having an outer circumferential surface, and a lower end, said inner cap member containing a plurality of spaced, external grooves formed about its outer circumferential surface;

(b) an interlocking member having a closed upper end and an open lower end, and having an inner circumferential surface and an outer circumferential surface, said interlocking member containing plurality of inwardly projecting pins spaced about its inner circumferential surface and a plurality of outwardly projecting pins spaced about its outer circumferential surface, said inwardly projecting pins slidably engaging and mating with the external grooves in said inner cap member securing said interlocking member to said inner cap member; and, (c) an outer cap member having an open upper end and an open lower end, and an inner circumferential surface, and having means at its lower end to rotatably secure said outer cap member to the lower end of said inner cap member with said interlocking member disposed between said inner cap member said outer cap member without engaging said outer cap member, said outer cap member having a plurality of spaced grooves formed about its inner circumferential surface in which said outwardly projecting pins of said interlocking member can become engaged to interlock said outer cap member, said interlocking member and said inner cap member to each other enabling said assemblage to be removed from a bottle to which it is secured.

2. The bottle closure assemblage of claim 1 wherein said external grooves in said inner cap member are parallel to each other and parallel to a longitudinal axis of said inner cap member.

3. The bottle closure assemblage of claim 1 wherein said spaced grooves in said outer cap member are parallel to each other and angularly off set from a longitudinal axis of said outer cap member.

4. The bottle closure assemblage of claim 3 wherein said grooves have upper ends, and said upper ends are closed.

5. The bottle closure assemblage of claim 1 which includes a tamper evident means removably secured across the open, upper end of said outer cap member.

6. A bottle closure assemblage comprising:

(a) a cylindrical inner cap member having means to be secured to and seal the contents of a bottle, and having an outer circumferential surface, and a lower end, said inner cap member containing a plurality of spaced external grooves formed about its outer circumferential surface, said grooves being parallel to each other and parallel to a longitudinal axis of said inner cap member;

(b) a cylindrical interlocking member having a closed upper end and an open lower end, and having an inner circumferential surface and an outer circumferential surface, said interlocking member containing a plurality of inwardly projecting pins spaced about its inner circumferential surface and a plurality of outwardly projecting pins spaced about its outer circumferential surface, said inwardly projecting pins slidably engaging and mating with the external grooves in said inner cap member securing said interlocking member to said inner cap member; and (c) a cylindrical outer cap member having an open upper end and an open lower end, and an inner circumferential surface, and having means at its lower end to rotatably secure said outer cap member to the lower end of said inner cap member with said interlocking member disposed between said inner cap member and said outer cap member without engaging said outer cap member, said outer cap member having a plurality of spaced grooves formed about its inner circumferential surface, said spaced grooves being parallel to each other and angularly off set from a longitudinal axis of said outer cap member and capable of accepting and engaging therein said outwardly projecting pins of said interlocking member to interlock said outer cap member, said interlocking member and said inner cap member to each other enabling said assemblage to be removed from a bottle to which it is secured.

7. The bottle closure assemblage of claim 6 wherein said spaced grooves in said outer cap member have upper ends, and said upper ends are closed.

8. The bottle closure assemblage of claim 6 which includes a tamper evident means removably secured across the open upper end of said outer cap member.

* * * * *